United States Patent [19]

Martin

[11] 4,330,938

[45] May 25, 1982

[54] CARPET STRIPPING MACHINE

[76] Inventor: Raymond G. Martin, 8160 W. State Street Rd., Winnebago, Ill. 61088

[21] Appl. No.: 262,198

[22] Filed: May 11, 1981

[51] Int. Cl.[3] ..... A47L 11/12

[52] U.S. Cl. ..... 30/169; 30/500; 299/37

[58] Field of Search ..... 30/169, 172, 170, 171, 30/500, 296 R, 122; 299/37

[56] References Cited

U.S. PATENT DOCUMENTS

| | | | |
|---|---|---|---|
| 2,874,946 | 2/1959 | Singleterry | 30/170 X |
| 3,074,090 | 1/1963 | Thompson | 299/37 X |
| 3,251,629 | 5/1966 | Cawley | 299/37 |
| 4,009,908 | 3/1977 | Alinder | 30/169 |
| 4,162,809 | 7/1979 | Anderson et al. | 299/37 |

OTHER PUBLICATIONS

Literature entitled "Tools"-Taylor No. 901 Carpet & Resilient Floor Covering Stripping Machine.

*Primary Examiner*—Jimmy C. Peters

*Attorney, Agent, or Firm*—Leydig, Voit, Osann, Mayer & Holt, Ltd.

[57] ABSTRACT

The machine includes a power-reciprocated blade adapted to be driven by a conventional electric drill and adapted to strip cemented carpet away from a floor. The blade and the handle grips of the machine are adapted to be shifted to laterally compact storage positions to facilitate carrying and storage of the machine.

10 Claims, 5 Drawing Figures

CARPET STRIPPING MACHINE

BACKGROUND OF THE INVENTION

This invention relates to a machine for stripping or cutting carpet away from a floor.

Certain types of carpet are cemented intimately to the underlying floor. When a carpet installer replaces the carpet, it is necessary for the installer to strip the old carpet away from the floor, usually with a cutting or scraping blade. While power-operated carpet stripping machines presently exist, such machines are extremely bulky and heavy and are difficult to use.

SUMMARY OF THE INVENTION

The general aim of the present invention is to provide a new and improved power-operated carpet stripping machine which, when compared with prior machines, is less expensive to make and is lighter in weight, simpler to use, and easier to transport and store.

A more detailed object of the invention is to provide a carpet stripping machine having a power-operated cutting blade which preferably is adapted to be reciprocated by a conventional electric drill. By driving the blade with a drill, which is a common tool possessed by virtually all carpet installers, there is no need to equip the stripping machine with its own motor and thus the initial cost of the machine is reduced.

Still another object is to provide a carpet stripping machine having a novel handle to enable easy maneuvering of the machine, both the handle and the blade being uniquely adapted to be moved to and locked in laterally compact inactive positions to facilitate carrying and storage of the machine.

The invention also resides in the relatively simple and low cost construction of the machine.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3:
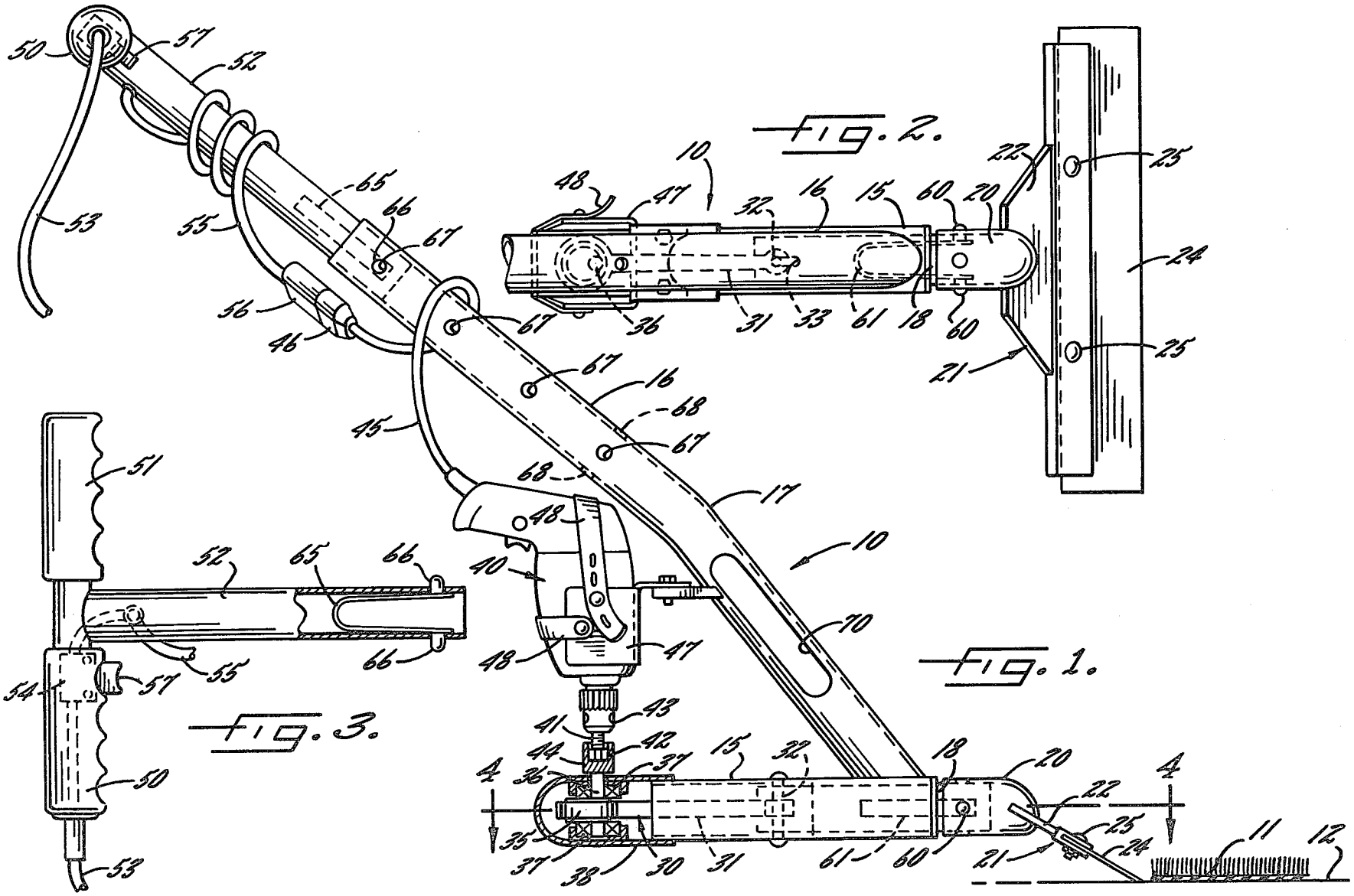
FIG. 1 is a side elevational view of a new and improved carpet stripping machine incorporating the unique features of the present invention, parts of the machine being broken away and shown in section.
FIG. 2 is a top plan view of the blade and the front portion of the machine shown in FIG. 1.
FIG. 3 is a top plan view of a portion of the handle of the machine shown in FIG. 1.

As shown in the drawings for purposes of illustration, the invention is embodied in a machine 10 (FIG. 1) for cutting carpet 11 away from a floor 12. Certain types of carpet (e.g., kitchen carpet) are bonded directly to the floor by cement and thus must be cut away from the floor with a scraping or stripping action when replacement of the carpet is required.

The present invention contemplates a new and improved power-operated carpet stripping machine 10 which is comparatively light in weight, which is easy to maneuver and operate and which is of relatively low cost. The machine is particularly characterized by its ability to be easily transported and stored and by the novel manner in which the machine is driven.

More specifically, the machine 10 includes a main frame member 15 (FIGS. 1 and 4) which herein is in the form of an elongated and generally horizontal sleeve that extends in a fore-and-aft direction. Secured rigidly to and extending upwardly and rearwardly from the forward end portion of the sleeve 15 is an elongated tubular handle 16 which preferably is bent slightly at 17 (FIG. 1) so that the upper end portion of the handle is inclined rearwardly relative to the lower end portion thereof.

A tube 18 (FIG. 4) is telescoped into the forward end portion of the sleeve 15 and is guided for back and forth sliding therein by a plastic bushing 19 which is fixed within the sleeve. Telescoped over and connected to the forward end of the tube 18 is a sleeve 20 which forms part of a blade assembly 21. The latter includes a blade holder 22 (FIG. 2) which is joined rigidly to the forward end of the sleeve 20 and further includes an elongated blade 24 which is secured releasably in the holder by screws 25. The blade 24 extends transversely of the sleeve 15 and the handle 16 and is inclined downwardly and forwardly from the sleeve 20 at about a 45 degree angle (see FIGS. 1 and 2).

The blade 24 is adapted to be reciprocated back and forth relative to the sleeve 15 and, as an incident thereto, serves to cut and strip the carpet 11 away from the floor 12 as the machine 10 is pushed forwardly. To reciprocate the blade, provision is made of a drive mechanism 30 (FIGS. 1 and 4) having a link or pitman 31 which is disposed within the sleeve 15. The forward end portion of the pitman 31 projects into the rear end portion of the tube 18 (see FIG. 4) and is connected pivotally thereto by a vertical pin 32. The pin 32 extends through elongated slots 33 (FIG. 2) formed in the top and bottom of the sleeve 15 and constrains the tube 18 for back and forth sliding.

Figure 4:
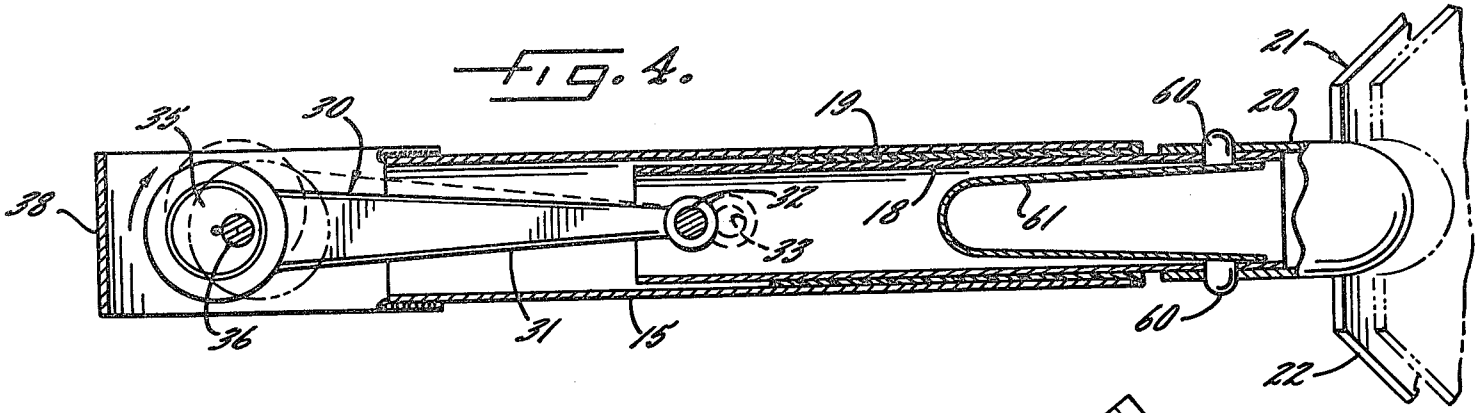
FIG. 4 is an enlarged fragmentary cross-section taken substantially along the line 4—4 of FIG. 1.

As shown in FIGS. 1 and 4, the drive mechanism 30 further includes an eccentric 35 which is rotatably journaled in the rear end portion of the pitman 31. A vertical input shaft or drive pin 36 whose axis is offset radially from that of the eccentric extends through and is rigid with the eccentric and is journaled at its ends by upper and lower bearings 37 (FIG. 1). The bearings are rigidly supported by a bracket 38 which is connected to and extends rearwardly from the rear end of the sleeve 15. When the drive pin 36 is rotated, the eccentric 35 acts through the pitman 31 to reciprocate the tube 18, the sleeve 20 and the blade 24 back and forth through a stroke of approximately ¼ inch.

Pursuant to the invention, an electric drill 40 is detachably connected to the machine 10 and is uniquely utilized to drive the pin 36 and effect reciprocation of the blade 24. Virtually every carpet installer possesses a drill which the installer uses for drilling screw holes for door strips and the like. By adapting the machine 10 so that the installer can use his own drill to drive the blade 24, there is no need of equipping the machine itself with a motor and thus the cost of the machine is reduced.

Advantageously, the shank of a bolt 41 (FIG. 1) with a hexagonal head 42 is gripped releasably by the rotary chuck 43 of the drill 40. The head of the bolt fits into and mates with a conventional wrench-type socket 44 which is welded securely to the upper end of the drive pin 36. Thus, when the motor of the drill is energized, the drive pin 36 is rotated by way of the chuck 43, the bolt 41 and the socket 44. The bolt is capable of pivoting slightly within the socket and thus accommodates any minor misalinement which might exist between the chuck 43 and the drive pin 36. In other words, the bolt 41 and the socket 44 function as a very low cost flexible coupling.

Any conventional hand-held electric drill can be used with the machine 10. The drill 40 which has been shown is a ⅜" drill with a variable speed motor having a power cord 45 (FIG. 1) with a conventional male connector or plug 46. The drill is cradled in an upright position in a bracket 47 which is attached to the rear side of the handle 16. Two flexible straps 48 hold the drill securely but releasably in the bracket.

As shown in FIGS. 1 and 3, a pair of oppositely extending hand grips 50 and 51 are mounted on the upper end of a tube 52 which is located at the upper end of the handle 16. The hand grips normally extend in the same direction as the blade 24. A power cord 53 leads out of the hand grip 50 and is adapted to be plugged into an electrical receptacle. The power cord is connected electrically to a trigger-type switch 54 which is housed within the hand grip 50. Another cord 55 (FIG. 1) also is connected to the switch and is provided with a female connector or socket 56 which is adapted to receive the plug 46 of the drill 40. The motor of the drill is adapted to be energized when the switch 54 is closed by squeezing a trigger 57 (FIG. 3) on the hand grip 50. The switch preferably is of the rheostat-type so that the speed of the drill motor can be controlled by the switch.

When the machine 10 is not in use, the drill 40 may be removed from the bracket 47 and used for other purposes. Of course, it will be appreciated that the machine 10 may be equipped with a motor of its own connected in a series path with the switch 54 and the power cord 53. The use of the drill is preferred, however, in order to reduce the cost of the machine.

Further in carrying out the invention, the blade assembly 21 and the hand grips 50 and 51 are adapted to be moved to inactive positions in order to make the machine 10 easier to carry and to facilitate compact storage of the machine in a truck or the like. This is achieved in part by rotatably mounting the sleeve 20 of the blade assembly 21 on the forward end portion of the tube 18. Normally, the sleeve 20 is positioned such that the blade 24 extends transversely of the handle 16 as shown in FIGS. 1 and 2. The blade normally is locked in its active position by two buttons 60 (FIG. 4) which project through a first pair of diametrically spaced holes in the tube 18 and through a second pair of diametrically spaced holes in the sleeve 20. The buttons are carried on the free ends of the legs of a U-shaped leaf spring 61 which is located within the tube 18. When the buttons are squeezed inwardly and pushed from the holes of the sleeve 20, the sleeve may be rotated on the tube 18. After the sleeve 20 has been rotated through ninety degrees, the buttons 60 automatically pop outwardly through a second pair of diametrically spaced holes in the sleeve and lock the blade assembly 21 in its storage position (see FIG. 5). In this position, the blade 24 is disposed in substantially the same plane as the sleeve 15 and the handle 16 and thus occupies less space in the transverse or lateral direction.

Figure 5:
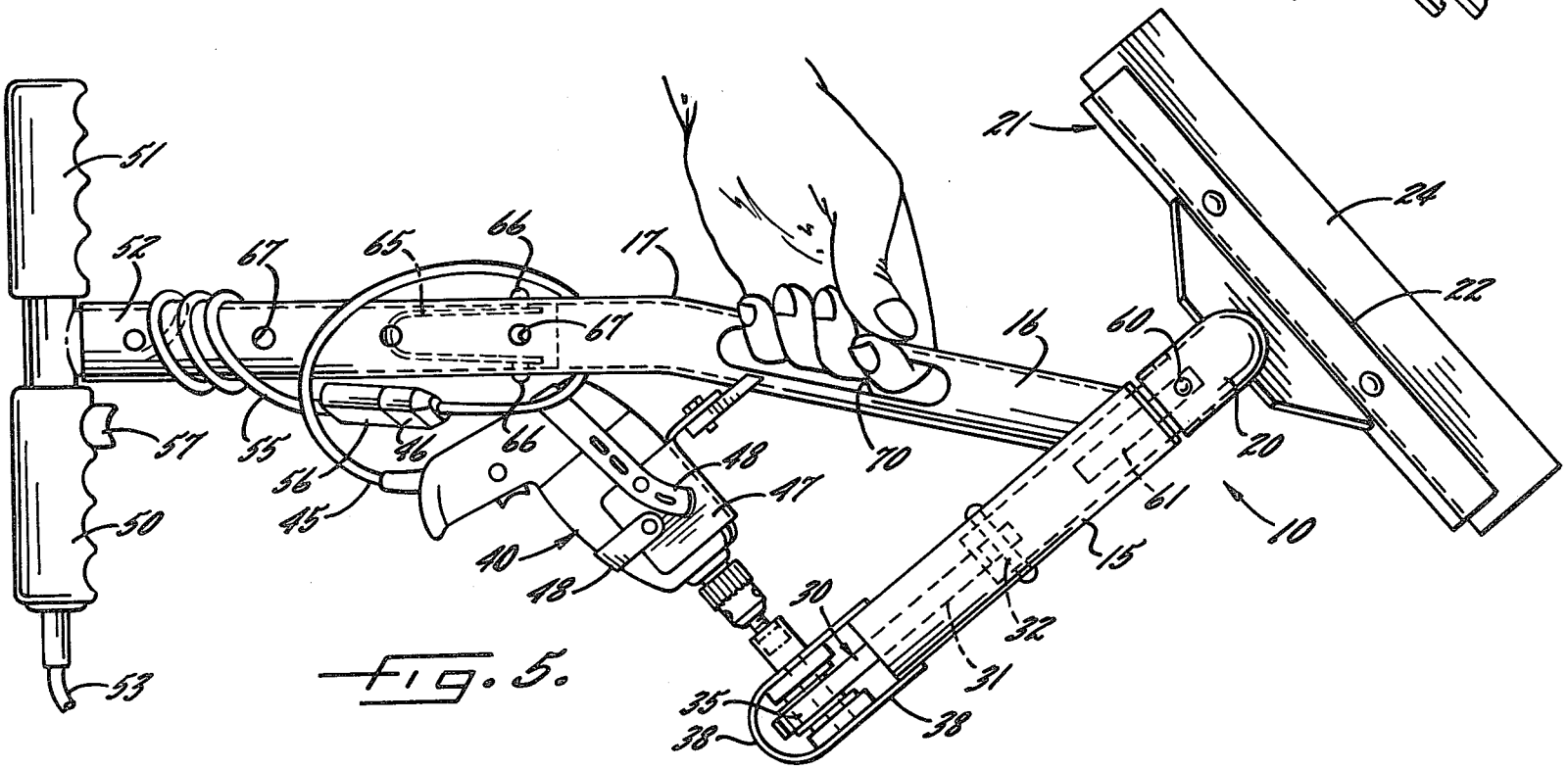
FIG. 5 is a view similar to FIG. 1 but shows the blade and the handle moved to their inactive storage positions.

Another U-shaped leaf spring 65 (FIG. 3) is disposed within the support tube 52 for the hand grips 50 and 51 and carries two buttons 66 which project through diametrically spaced holes in the tube. The tube 52 is telescoped into the upper end portion of the handle 16 and is adapted to be shifted between extended and retracted positions relative to the handle to adjust the hand grips to the height of the operator. Thus, several pairs of holes 67 are formed in and are spaced along the handle 16 and are adapted to receive the buttons 66 to hold the tube 52 releasably in a selected position along the length of the handle. In keeping with the invention, another pair of holes 68 (FIG. 1) is formed through the handle at right angles to the lowermost holes 67. By squeezing the buttons 66, the tube 52 may be turned within the handle 16 to turn the hand grips 50 and 51 through ninety degrees from the active positions shown in FIG. 1 to the storage positions shown in FIG. 5, the buttons entering the holes 68 when the hand grips are in the storage positions. Thus, the hand grips can be positioned to extend in generally the same direction as the blade 24 when the blade is in its storage position (see FIG. 5). Accordingly, the machine 10 can be made very compact in a transverse or lateral direction and hence can be easily stored and carried. To facilitate carrying of the machine, two diametrically spaced slots 70 are formed through the handle 16 and enable the operator to lift and carry the machine as shown in FIG. 5.

I claim:

1. A machine for cutting a carpet away from a floor, said machine comprising a generally horizontal frame having front and rear ends, a handle projecting upwardly and rearwardly from said frame, an elongated transversely extending blade located in front of said frame, means mounting said blade for back and forth reciprocation on said frame, mechanism supported on said frame and operable when rotated to cause said blade to reciprocate back and forth, and an electric drill detachably secured to said machine, said drill having an electric motor and having a power-rotated chuck releasably connected to said mechanism and operable to rotate said mechanism when said motor is energized, said mechanism comprising an input shaft adapted to be rotated about an upright axis, an upwardly opening wrench-type socket secured to the upper end of said shaft, and a bolt having a head sized and shaped to fit into and mate with said socket and having an upwardly projecting shank adapted to be gripped releasably by said chuck.

2. A machine for cutting a carpet away from a floor, said machine comprising a generally horizontal frame having front and rear ends, a handle projecting upwardly and rearwardly from said frame, an elongated transversely extending blade located in front of said frame, means mounting said blade for back and forth reciprocation on said frame, mechanism supported on said frame and operable when rotated to cause said blade to reciprocate back and forth, an electric drill detachably secured to said machine, said drill having an electric motor and having a power-rotated chuck releasably connected to said mechanism and operable to rotate said mechanism when said motor is energized, a pair of handle grips extending transversely in opposite directions from the upper end portion of said handle, an electrical power cord leading from one of said handle grips, a female electrical connector carried by said handle, an electrical cord connected electrically to the motor of said drill and having a male connector plugged releasably into said female connector, and a manually operable switch on said handle and connected in series with said power cord and said female connector, said switch being operable when closed and opened to energize and de-energize said motor.

3. A machine as defined in claim 2 in which said motor is a variable speed motor, said switch including means for controlling energization of said motor to vary the speed thereof.

4. A machine for cutting a carpet away from a floor, said machine comprising a generally horizontal frame having front and rear ends, a handle projecting upwardly and rearwardly from said frame, an elongated transversely extending blade located in front of said frame, mounting means supporting said blade on said frame for turning about a generally fore-and-aft extending axis between active and storage positions, said blade extending transversely of said handle when in said active position and being disposed substantially in the plane of said handle when in said storage position, means for releasably locking said blade in each of its positions, said mounting means also supporting said blade for back and forth reciprocation on said frame, mechanism supported on said frame and operable when rotated to cause said blade to reciprocate back and forth, and an electric drill detachably secured to said machine, said drill having an electric motor and having a power-rotated chuck releasably connected to said mechanism and operable to rotate said mechanism when said motor is energized.

5. A machine as defined in claim 4 further including a pair of hand grips extending transversely in opposite directions from the upper end portion of said handle, means mounting said hand grips on said handle for turning about the axis of the handle between active and storage positions, said hand grips extending generally in the same direction as said blade when said hand grips and said blade are in said active positions and also extending generally in the same direction as said blade when said hand grips and said blade are in said storage positions, and means for releasably locking said hand grips in each of their positions.

6. A machine as defined in claim 5 further including means mounting said hand grips on said handle for telescoping relative to said handle between extended and retracted positions, and means for releasably locking said hand grips in each of the latter positions.

7. A machine for cutting a carpet away from a floor, said machine comprising a generally horizontal frame having front and rear ends, a handle projecting upwardly and rearwardly from said frame, an elongated blade located in front of said frame and supported on said frame for back and forth reciprocation, mechanism supported on said frame and operable when rotated to cause said blade to reciprocate back and forth, an electric motor connected to said mechanism and selectively operable to rotate said mechanism, means mounting said blade on said frame for turning about a generally fore-and-aft extending axis between active and storage positions, said blade extending transversely of said handle when in said active position and being disposed substantially in the plane of said handle when in said storage position, means for releasably locking said blade in each of its positions, a pair of hand grips extending transversely in opposite directions from the upper end portion of said handle, means mounting said hand grips on said handle for turning about the axis of the handle through approximately ninety degrees between active and storage positions, and means for releasably locking said hand grips in each of their positions.

8. A machine as defined in claim 7 further including means mounting said hand grips on said handle for telescoping relative to said handle between extended and retracted positions, and means for releasably locking said hand grips in each of the latter positions.

9. A machine as defined in claim 7 further including an electrical power cord extending from one of said hand grips, and a trigger-type switch on one of said hand grips and connected in series with said power cord and said motor, said switch being operable when closed and opened to energize and de-energize said motor.

10. A machine as defined in claim 7 in which said motor constitutes the motor of an electric drill detachably secured to said machine and having a rotatable chuck releasably secured to said mechanism.

* * * * *